US006237272B1

(12) United States Patent
Scott

(10) Patent No.: US 6,237,272 B1
(45) **Date of Patent: *May 29, 2001**

(54) BREECH BLOCK SAFETY DEVICE

(75) Inventor: Randy Lee Scott, 17849 Stella Solaris / P.O. Box 340, Lakehead, CA (US) 96051

(73) Assignee: Randy Lee Scott, Lakehead, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/725,606

(22) Filed: Oct. 3, 1996

(51) Int. Cl.[7] ..... F41A 17/44
(52) U.S. Cl. ..... 42/70.11; 42/77
(58) Field of Search ..... 42/70.11, 9, 2, 42/14, 26, 40; 89/145, 153, 164

(56) References Cited

U.S. PATENT DOCUMENTS

| | | | | |
|---|---|---|---|---|
| 3,444,639 | | 5/1969 | Rockwood | 42/1 |
| 3,848,350 | | 11/1974 | Seminiano | 42/1 N |
| 4,776,123 | | 10/1988 | Ascroft | 42/70.11 |
| 5,048,211 | * | 9/1991 | Hepp | 42/70.11 |
| 5,070,635 | | 12/1991 | Cvetanovich | 42/70.11 |
| 5,097,613 | * | 3/1992 | Miller et al. | 42/70.01 |
| 5,179,234 | * | 1/1993 | Cvetanovich | 42/70.11 |
| 5,315,778 | * | 5/1994 | Wolford | 42/70.11 |

* cited by examiner

*Primary Examiner*—Charles T. Jordan
*Assistant Examiner*—Denise J. Buckley

(57) ABSTRACT

A breech Block safety device for preventing weapons from being accidentlly loaded while at home or on display in businesses and military applications. The breech Block device utilizes two O-rings and the two grooved angles in which the O-rings are seated, that serves to secure and hold the safety breech block in location. The use of the O-rings and grooves ensures a firm hold in the chamber, plus the angles of the seat walls cause a easy insertion and a restricted extraction of the plug. The composition of the breech block makes it inexpensive for mass production and manufacturing techniques. The two O-rings fit within the two grooves that is slightly wider than the thickness of the O-ring which causes the a easy insertion and a secure hold in the chamber and a restricted extraction with no shearing of the O-rings. Once inserted, the breech block is entirely within the firing chamber and thus does not interfere with the operating action of the weapon, other than the weapon can not be accidentally loaded, until breech block is removed. The breech block can only be removed by a cleaning rod inserted through the muzzle to force the breech block out of the firing chamber. The use of bright colors or materials enables the weapon breech to be inspected and visual sighting can be made easily for "safety".

12 Claims, 3 Drawing Sheets

BREECH BLOCK SAFETY DEVICE

BACKGROUND OF THE INVENTION

1. Field of the Invention

This invention pertains to weapons safety devices, and more specifically to a device for preventing the accidental loading and discharge of firearms.

2. Description of the Background Art

The accidental loading and discharge of firearms stands as a major hazard associated with the keeping of firearms. Every year numerous inexperienced individuals, and unsupervised youngsters, are killed in accidental shootings. Therefore, a need has existed for devices which prevent the accidental loading and/or discharge of firearms.

A device known as the "breech block safety device" has arisen as an attempt to solve the accidental loading/discharge problem. These devices generally take the shape of a plastic or metallic plug which occupy the breech of a firearm, and which cannot be easily extracted.

For example, U.S. Pat. No. 5,070,635 issued to Cvetanovich on Dec. 10, 1991, discloses a breech block safety device which incorporates an O-ring disposed in a groove, the O-ring having a diameter and thickness corresponding to the size of the breech of the firearm in which it is used. The width of the groove is substantially greater than the thickness of the O-ring, thereby causing the O-ring to expand upon inserting into the breech. While this device cannot be removed by the extractor mechanism present on the actions of firearms, it can be easily removed by pushing it out of the breech with a cleaning rod. A drawback exists in that children, applying very little pressure with a cleaning rod, or a hard jolt to the weapon, could easily dislodge this device. Additionally, because the groove in the Cvetanovich device has vertical sidewalls, the O-ring tends to shear against these sidewalls, during insertion or extraction of the device, thereby causing O-ring failure, which subsequently causes this device to fall easily from the breech, rendering it useless. Finally, this device does not fit well into tapered rifle chambers and therefore has limited utility for rifles.

U.S. Pat. No. 4,776,123, issued to Ascroft on Oct. 11, 1988 discloses a safety plug for firearm chambers which is incapable of being ejected by the extractor mechanisms present on many firearms. This device is press-fitted into the bore of the firearm by having a diameter slightly greater that the bore of the firearm. To fit properly, this device requires the diameter of the plug to be precisely determined relative to the barrel bore. Variations in the wear of the bore, or deposits therein, would require corresponding adjustments in the plug diameter. Such a pressure fit as employed by the Ascroft device has a small surface area of contact between the plug and the firearm, and simply jarring the firearm could cause the safety plug to dislodge or even drop out.

U.S. Pat. No. 3,444,639, issued to Rockwood on May 20, 1969, discloses another safety plug for firearm breeches. This design is capable of being ejected by the firearm extractor mechanism and, therefore, can be easily dislodged simply by ejecting the plug in the same manner as ejecting a cartridge.

U.S. Pat No. 3,848,350, issued to Seminiano on Nov. 19, 1974, discloses still another plug. The primary objective of this device is to serve as a "dry fire" plug for center-fire firearms, or shotguns. This plug can also be ejected simply by using the firearm extractor mechanism.

A need therefore exists for a breech block safety device which cannot be removed by forces produced by a young child, or accidental jarring. Additionally, a need exists for a breech block safety device with will remain in the breech of a firearm despite wear, pitting, or deposits being present therein. The present invention satisfies these needs.

The foregoing patents and other information reflect the state of the art of which the inventor is aware, and is tendered with a view toward discharging the inventor's acknowledged duty of candor in disclosing information which may be pertinent with regards to the patentability of the present invention. It is respectfully stipulated, however, that the disclosed patents and other information do not teach or render obvious, singly or when considered in combination, the inventor's claimed invention.

SUMMARY OF THE INVENTION

By way of example and not of limitation, the present invention pertains to a breech block safety device for preventing the accidental chambering of cartridges in firearms. This device can be adapted to all firearms, including rifles, pistols, and shotguns.

This device is designed to load into the breech of a firearm, thereby preventing a cartridge from occupying the same space in the chamber. In a first embodiment of the invention, the breech block safety device is comprised of an elongate cylindrical body having both a diameter and length slightly less than the corresponding diameter and length of the breech in which it is loaded. A pair of O-rings are disposed in grooves cut into the cylindrical body, the grooves dividing the cylindrical body into a front member, a middle member and a rear member, all these members having substantially the same diameter.

Each groove is cut to a depth slightly less than the diameter of each O-ring, such that the O-ring protrudes above the cylindrical body of the device. The groove width is slightly wider than the diameter of the O-ring disposed therein, so that the O-ring can expand horizontally within the groove upon being inserted into the breech. Upon insertion, the O-ring exacts a pressure fit against the inside walls of the breech, in which it is inserted. Each groove is bordered circumferentially by a leading angled sidewall and a trailing angled sidewall, these angles differing in their angular dimensions. This relationship of the O-rings and difference in angles of the leading and trailing sidewalls allows easy insertion of the device into the breech of a firearm, but difficult extraction of the device therefrom.

In a second embodiment of the breech block safety device, a single, elongate, groove is cut into the cylindrical body, thereby dividing the cylindrical body up into a front member and a rear member. The elongate groove is bordered by a leading angled sidewall and a trailing angled sidewall, these angles differing in their angular dimensions. A sleeve, instead of an O-ring, is positioned in this single groove, this sleeve protruding slightly above the cylindrical body. Similarly to the O-rings previously described, the sleeve serves as a means of pressure fitting the breech block safety device against the inside walls of a breech. The relationship of the sleeve, and the difference in angles of the sidewalls, allows easy insertion of the device into the breech of a firearm, but difficult extraction of the device therefrom.

The engagement of either embodiment of the breech block safety device within the breech of a firearm is such that an adult applying significant downward pressure with a cleaning rod can remove the device from the breech. However, a small child would encounter significant difficulty in attempting to remove this device with a cleaning rod, or in attempting to remove it by jarring the firearm.

This breech block safety device will be more fully understood through the following objects and advantages:

An object of the invention is to provide a breech block safety device which deters small children from attempting to load a firearm.

Another object of the invention is to provide a breech block safety device which is universal in design and therefore can be adapted to any caliber of firearm having a breech, including pistols, rifles, shotguns, machine guns, and cannons.

Still another object of the invention is to provide a breech block safety device which can be easily inserted into a breech, but is difficult to remove from said breech.

A still further object of the invention is to provide a breech block safety device which can only be removed by the insertion of a cleaning rod, through the muzzle of a firearm, and applying significant force to dislodge the device from the breech.

Another object of the invention is to provide a breech block safety device of low cost and simple manufacture, thereby making this device inexpensive and readily accessible to the public.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
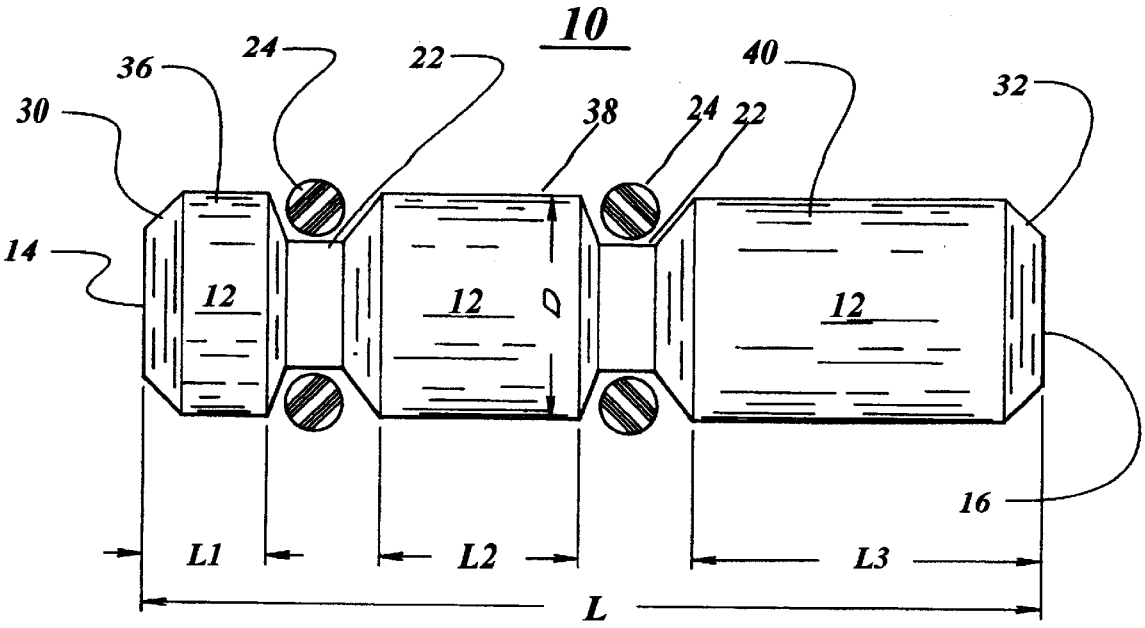
FIG. 1 is side view of the preferred embodiment of the breech block safety device which is the present invention; this embodiment employing O-rings for contacting the inside of a breech.
Figure 2:
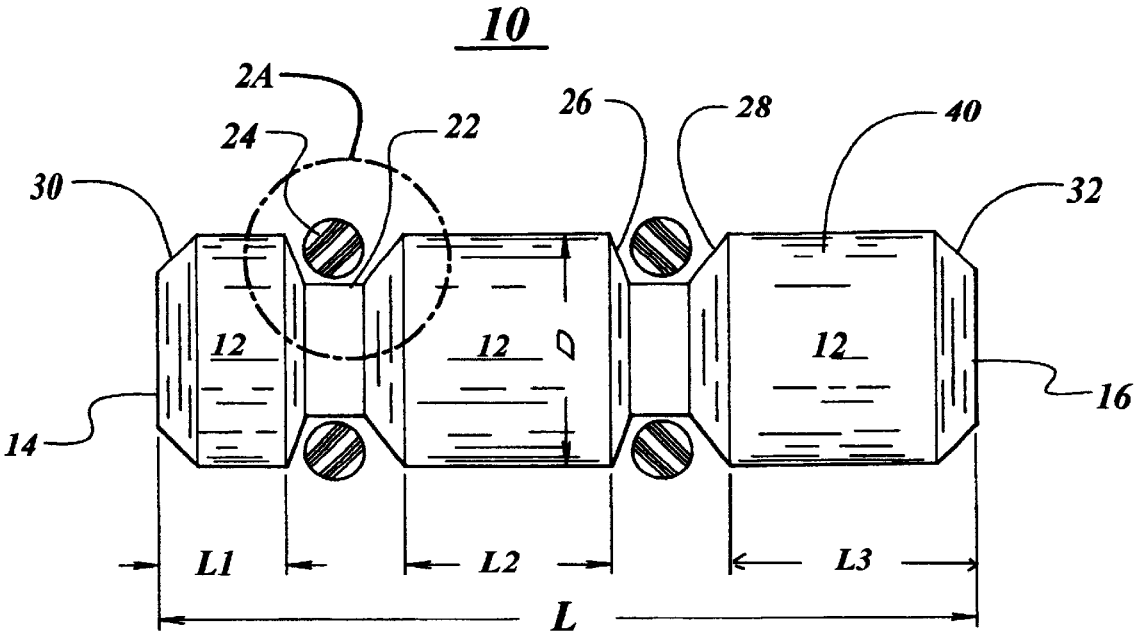
FIG. 2 is a side view of the preferred embodiment having a shorter rear member than that shown in FIG. 1, this version of the preferred embodiment for use in firearms with smaller breeches, such as pistols.
Figure 2A:
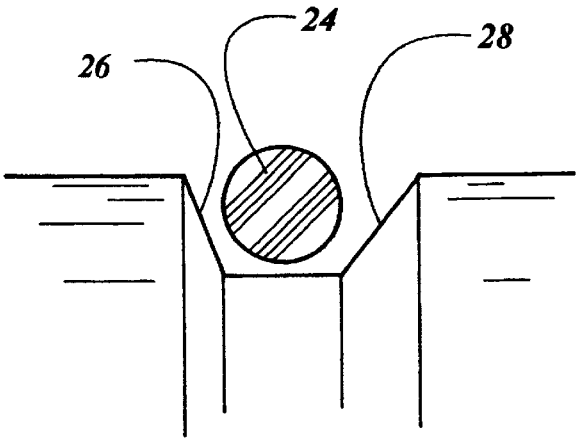
FIG. 2A is a side close-up view of the O-ring component of the preferred embodiment and corresponding leading angled sidewall and trailing angled sidewall in accordance with the invention.
Figure 3:
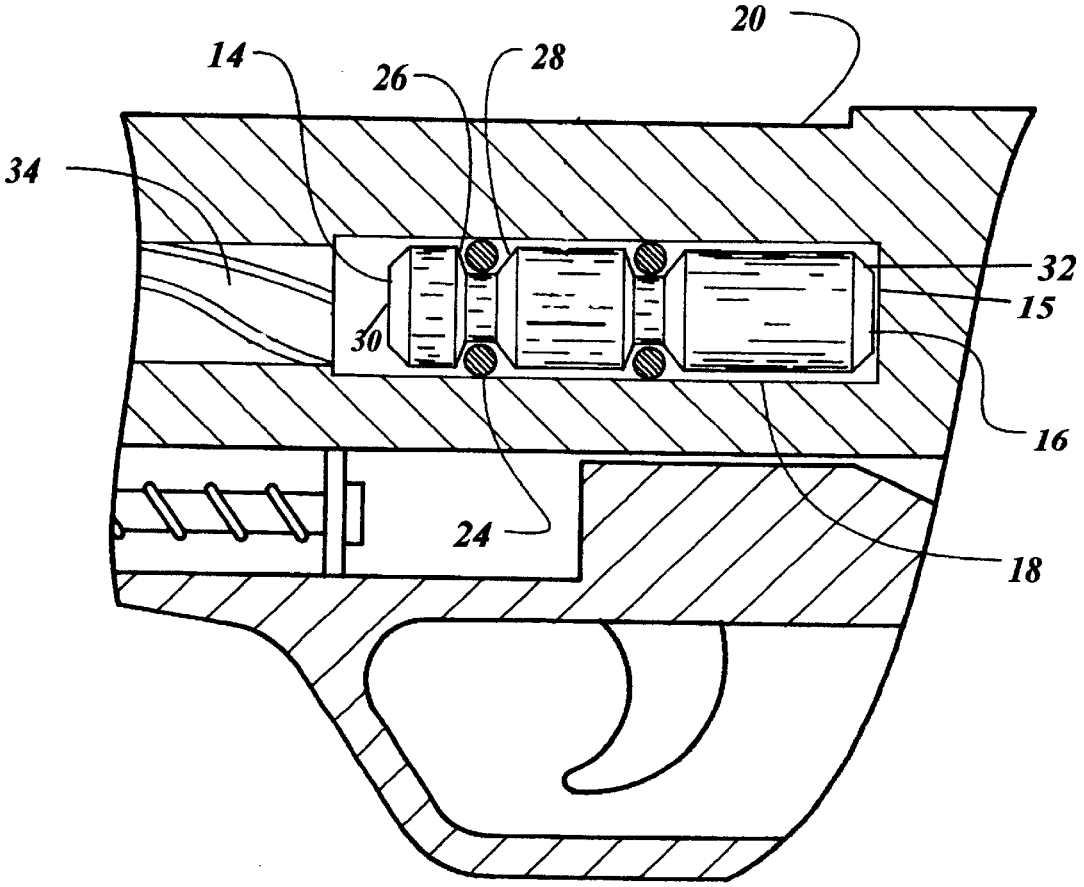
FIG. 3 is a side view of the preferred embodiment of the breech block safety device which is the present invention, positioned in a breech.

Referring more specifically to the drawings, the preferred embodiment of the breech block safety device 10 which is the present invention is shown in FIG. 1 FIG. 2 and FIG. 2A. This embodiment generally comprises an elongate cylindrical body 12 having a front muzzle end 14 for insertion into a firearm, and a rear action end 16 which lies flush with the closed action 15 of a firearm, as shown in FIG. 3, which illustrates device 10 placed inside the breech 18 of a pistol 20. Two grooves 22 are cut into cylindrical body 12, each groove 22 being occupied by a corresponding O-ring 24. Bordering each groove 22 and corresponding O-ring 24 is a leading angled sidewall 26, and a trailing angled sidewall 28, both of these angled sidewalls 26,28 continuing circumferentially around each groove 22. Grooves 22 are of a particular depth so that the selected O-rings 24 will protrude slightly above cylindrical body 12, when they are positioned in grooves 22. As best seen in FIG. 3, O-rings 24 exact a pressure fit against the inside walls of breech 18, holding device 10 firmly therein.

Cylindrical body 12 has a diameter, D, which is less than the diameter of the breech in which device 10 is placed. Additionally, cylindrical body 12 has an overall length L which is less than the length of a weapon's breech, so that upon positioning in the breech 18, the action end 16 will be set flush with the action 15 of the firearm in which it is placed, upon closing. This positioning is clearly illustrated in FIG. 3.

It has been found that providing device 10 with tapers 30,32 on muzzle end 14 and action end 16, allows an easy-fitting, nearly tamper proof, breech block safety device. Upon insertion, taper 30 on muzzle end 14 allows device 10 to slide forward into the breech, without obstruction. In many rifle calibers, the breech has a tapered front end, and hence the muzzle end 14 will continue forward into this tapered front end until it narrows to a point of contact with taper 30, at which point device 10 can go no further. As seen in FIG. 3, for pistol chambers which are usually not tapered, taper 30 of muzzle end 14 abuts against the barrel bore 34, and stops.

Upon full forward placement of device 10 into the breech of a firearm, the action of the firearm can close and the end of the action sets flush against the action end 16 of device, as previously discussed. Taper 32 on action end 16 prevents extraction of device 10 by tools or fingers. Furthermore, the close tolerances of cylindrical body 12 with the inside of the breech 18 prevent access by tools.

As seen in FIGS. 1–2A grooves 22 divide cylindrical body 12 up into a front member 36 having a length L1, a middle member 38 having a length L2 and a rear member 40 having a length L3. Depending on the length of the breech, L3 of rear member 40 is longer or shorter. For example, the device 10 in FIG. 1 has a longer rear member for a large rifle such as a .30-06, .308, .30-40 Krag, or for a shotgun. The device 10 shown in FIG. 2, has a shorter rear member 40 than that shown in FIG. 1, this device 10 being ideal for pistol breeches.

The dimension L1 of the front member 36 is preferably approximate to the diameter of the breech and no less than half the radius of the breech. Front member dimensions greater than this preferred range will prevent device 10 from securely seating within a breech, when muzzle end 14 is adjacent to the front end of the breech, due to improper seating of O-rings 24 against the inside walls of the breech. Alternatively, dimensions smaller than this preferred range could cause front member 36 to proceed forward beyond the breech and become locked in the barrel. Additionally, dimensions smaller than this preferred range could cause front member 36 to lack sufficient strength to withstand a forcible attempt to chamber a round in the weapon.

The inventor has found that the angular dimension of the two leading 26 and trailing 28 angled sidewalls is critical for the proper functioning of O-rings 24. When leading angle 26 is approximately 69 degrees and trailing angle 28 is approximately 52 degrees, the optimal balance between easy insertion and difficult extraction of device 10 is achieved, due to optimal seating of O-rings 24 against breech walls. Additionally it has been found that by providing leading 26 and trailing 28 angled sidewalls, the shearing of O-rings 24 is reduced, and a longer O-ring life is achieved when compared to prior art breech block safety devices employing O-rings and vertical sidewalls. By reducing the potential for shearing of the O-rings 24, the likelihood of device 10 failing is greatly reduced.

When these approximate angular dimensions for leading and trailing angled sidewalls 26, 28 are adhered to, a downward pressure against muzzle end 14 of 20–100 pounds must be applied, with a cleaning rod through the barrel, to dislodge device 10. This amount of pressure needed to dislodge device 10 is greater than most small children can generate by pushing downward with a cleaning rod. Additionally, this amount of pressure is greater than that generated by an attempt to load a round into the chamber of almost all firearms. Therefore, a round being delivered from the magazine of a firearm, for example, could not dislodge device 10, and mistakenly load the weapon. Finally, the inventor has found that jarring the weapon, by striking the butt of a rifle sharply against the ground, for example, will not dislodge the device.

Following are examples of design dimensions for the preferred embodiment of device 10, as used in a rifle and as used in a pistol:

EXAMPLE 1—30.06 RIFLE

For a .30-06 caliber safety device, cylindrical body has a diameter of approximately 0.436 inches, a length of approximately 1.9 inches; a front O-ring size of AS-568 #011; a rear O-ring size of AS-568 #012; a front groove depth of approximately 0.066 inches; a rear groove depth of approximately 0.052 inches; groove width of approximately 0.068 inches; L1 length of approximately 0.412 inches; L2 length of approximately 0.864 inches; L3 length of approximately 0.487 inches; leading angles of approximately 69 degrees; trailing angle of approximately 52 degrees.

EXAMPLE 2—9 mm PISTOL

For a 9 mm caliber safety device, cylindrical body has a diameter of approximately 0.370 inches; a length of approximately 0.715 inches; both front and rear O-ring sizes of AS-568 #010; both groove depths of approximately 0.082 inches; both groove widths of 0.091 inches; L1 length of approximately 0.185 inches; L2 length of approximately 0.176 inches; L3 length of approximately 0.194 inches; leading angles of approximately 69 degrees; trailing angles of approximately 52 degrees.

Figure 4:
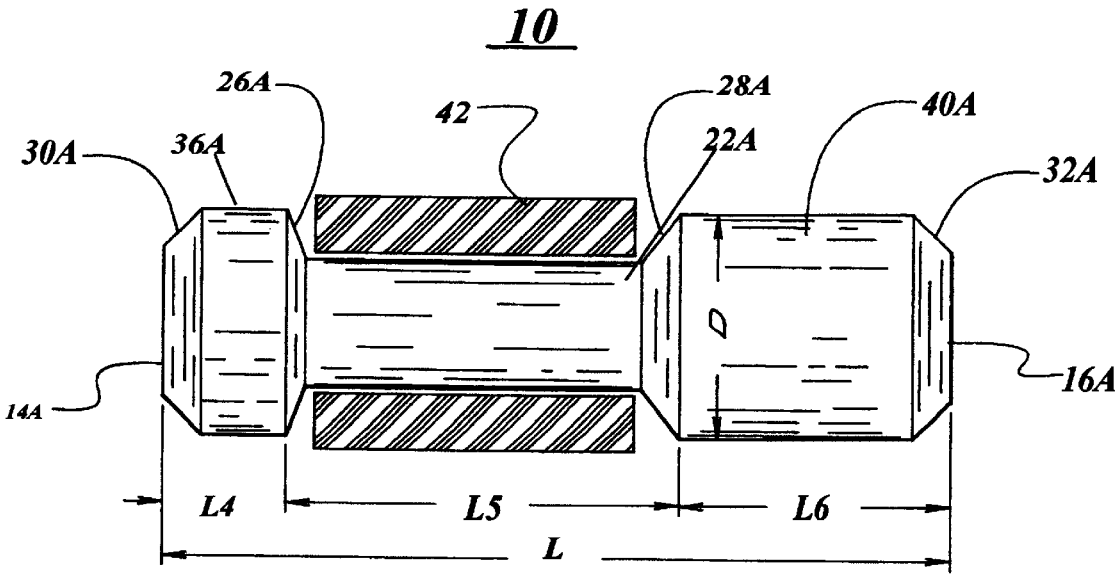
FIG. 4 is a side view of a second embodiment of the present invention, this embodiment employing a sleeve for contacting the inside of a breech.

FIG. 4 illustrates a second embodiment of the present invention, this embodiment employing a single sleeve 42 constructed from a rubberized or equivalent material, positioned between a front member 36A and a rear member 40A. Sleeve 42 is bordered by a first leading angled sidewall 26A and a second trailing angled sidewall 28A, leading angle being of approximately 69 degrees and trailing angle being of approximately 52 degrees. In this embodiment, sleeve 42 is of a length L5 which is dimensioned so that once muzzle end 14A is in contact with the front of the breech or barrel, sleeve 42 is likewise in full contact with the interior of the breech of the weapon. This embodiment operates similarly to the first embodiment, except that extraction of this embodiment with a cleaning rod is generally more difficult.

Breech block safety device 10 may be fabricated from a variety of metals, but plastics are preferred due to cheap cost achieved by injection molding and due to the fact that bright colors can be incorporated into plastics. Upon loading into the breech, bright colors make the device readily visible to a user who might unknowingly attempt to chamber a round. Also, the selection of plastic material should favor materials which are resistant to breakdown from commercial gun oils and greases. In fact it has been found desirable to lightly coat the device with a thin film of gun oil for purposes of preventing rust and corrosion during storage inside a firearm.

Accordingly, this invention provides a breech block safety device which prevents the accidental loading of firearms. This device can only be extracted from the breech of a firearm through the application of significant downward pressure with a cleaning rod. The amount of pressure necessary to dislodge the device is greater than the amount of pressure which can be generated by a small child. Additionally, this device is designed for long life and reliable operation.

Finally, although the description above contains many specificities, these should not be construed as limiting the scope of the invention, but as merely providing illustrations of some of the presently preferred embodiments of this invention. Thus the scope of this invention should be determined by the appended claims and their legal equivalents.

What is claimed is:

1. A breech block safety device for insertion into a breech of a firearm and preventing the accidental loading of said firearm, the device comprising:

a) a cylindrical body having a muzzle end and an action end, said body further having an overall length slightly less than the length of said firearm breech an overall diameter slightly less than the length of said firearm breech an overall diameter slightly less than the diameter of said breech, said body being sectioned into at least two members by at least one groove, said groove being bordered by a first leading angled sidewalls and a second trailing angled sidewall; and (b) pressure fit means for achieving a pressure fit against the inside walls of said breech, said pressure fit means being disposed in said groove, said groove having a width slightly greater than said pressure fit means.

2. The breech block safety device as recited in claim 1, wherein said leading and trailing angled sidewalls differ in angular dimension.

3. The breech block safety device as recited in claim 2, wherein said leading angled sidewall has an angular dimension of approximately 69 degrees and said trailing angled sidewall has an angular dimension of approximately 52 degrees.

4. The breech block safety device as recited in claim 1, wherein both said muzzle end and said action end are tapered.

5. A breech block safety device for insertion into a breech of a firearm, said firearm having a caliber, a barrel, an action, and a breech having a diameter and length, the safety device comprising:

a) a cylindrical body having a diameter slightly less than the diameter of said breech and a length slightly less than the length of said breech;

b) two O-rings having a diameter corresponding to the caliber of said breech of said firearm;

c) two O-ring grooves disposed circumferentially in said body, said grooves having depths less than the thickness of said O-rings, said grooves having widths slightly greater than the thickness of said O-rings;

d) each of said O-ring grooves having leading and trailing angled sidewalls, said angled sidewalls for allowing easy insertion of said safety device into said breech of said firearm, but restricting removal of said safety device from said breech, said safety device being held firmly within said breech, thereby permitting the action of said firearm to fully close and thereby render said firearm safe until said safety device is removed from said breech, said device being removed by insertion of a rod into a muzzle of said firearm to push said device free from said breech.

6. The safety device as recited in claim 5, wherein said leading angled sidewall is approximately 69 degrees and said trailing angled sidewall is approximately 52 degrees.

7. The safety device as recited in claim 5, wherein said cylindrical body has tapered ends for guiding said device during insertion and removal of said device into and from said breech of said firearm.

8. The safety device as recited in claim 5, wherein said cylindrical body is made of a plastic material that is resistant to heat, rust, oils and greases.

9. A safety device for insertion into a breech of a firearm, said firearm having a caliber, a barrel, a muzzle, an action, and a breech having a diameter and length, said safety device comprising:

a) a cylindrical body having a diameter slightly less than the diameter of the breech of said firearm and having a length slightly less that the length of the breech of said firearm;

b) a sleeve having a diameter corresponding to the caliber of the breech of said firearm;

c) a groove disposed circumferentially in said cylindrical body, said groove having a groove depth less than a thickness of said sleeve, said groove further having a groove width that is slightly greater than the length of said sleeve, such that when said sleeve is inserted into said groove and said device is inserted into said breech of said firearm, said device is firmly held within said breech, thereby permitting said action of said firearm to fully close and thereby render said firearm safe until said safety device is removed from said breech;

d) said groove having a leading angled sidewall and a trailing angled sidewall for allowing easy insertion of said device into said breech of said firearm, but restricting removal of said device from said breech, said device being removed by insertion of a rod into said muzzle of said firearm to push said device free from said breech.

10. The breech block safety device as recited in claim 9, wherein said leading and trailing angled sidewalls differ in angular dimension.

11. The breech block safety device as recited in claim 10, wherein said leading angled sidewall has an angular dimension of approximately 69 degrees and said trailing angled sidewall has an angular dimension of approximately 52 degrees.

12. The breech block safety device as recited in claim 11, wherein both of said muzzle end and said action end are tapered.

* * * * *